US008428297B2

(12) United States Patent
Adelman

(10) Patent No.: US 8,428,297 B2
(45) Date of Patent: Apr. 23, 2013

(54) ACOUSTIC TRANSDUCER

(75) Inventor: Roger A. Adelman, Villa Hills, KY (US)

(73) Assignee: Technology Properties Limited, Cupertino, CA (US)

( * ) Notice: Subject to any disclaimer, the term of this patent is extended or adjusted under 35 U.S.C. 154(b) by 422 days.

(21) Appl. No.: 12/714,083

(22) Filed: Feb. 26, 2010

(65) Prior Publication Data

US 2010/0220889 A1 Sep. 2, 2010

Related U.S. Application Data

(60) Provisional application No. 61/156,275, filed on Feb. 27, 2009.

(51) Int. Cl.
*H04R 11/02* (2006.01)

(52) U.S. Cl.
USPC ..... 381/412; 381/414; 381/419; 381/421

(58) Field of Classification Search ..... 381/431, 381/412, 414, 419, 421
See application file for complete search history.

(56) References Cited

U.S. PATENT DOCUMENTS

| | | | | |
|---|---|---|---|---|
| 5,587,615 | A * | 12/1996 | Murray et al. | 310/30 |
| 7,558,395 | B2 * | 7/2009 | De Haan | 381/338 |
| 2002/0191808 | A1 * | 12/2002 | Croft et al. | 381/431 |

* cited by examiner

*Primary Examiner* — Davetta W Goins
*Assistant Examiner* — Amir Etesam

(57) ABSTRACT

An acoustic transducer includes a sound-producing member at least partially disposed within the first magnetic flux gap region between the magnetic poles, the sound-producing assemblage is magnetically excited through a magnetic circuit that passes from a location outside the magnetic flux gap region to inside the magnetic flux region through an air gap.

1 Claim, 2 Drawing Sheets

ACOUSTIC TRANSDUCER

RELATED APPLICATIONS

This application claims priority under 35 U.S.C. §119 (e) to U.S. Provisional Application Ser. No. 61/156,275 filed Feb. 27, 2009.

FIELD OF THE INVENTION

The present invention generally relates to the field of electro acoustic transducers. While the invention has applicability to a wide range of diverse applications, it will be specifically disclosed in a speaker for producing air-borne sound waves.

BACKGROUND

Miniature electro acoustic transducers have long been fundamental components of communications equipment ranging from telephones to hearing aids and most recently to personal listening devices such as MP3 players. In general there are two technologies available for producing such speakers with names to the industry as "balanced armature" and "moving coil." Balanced armature technology uses two magnetic fields, one static and another responsive to the signal to produce force that moves the sound generating surface. Moving coil technology employs a single, static radially disposed, magnetic field through which a coil resides in an air gap in the radial field. When current flows through the coil in response to an electrical signal carried it the coil, a force is generated perpendicular to the plane of both the radial magnetic flux and the path of the wire coiling through the air gap. Each technology finds usefulness in particular applications, the moving coil technology dominating generally larger speakers. As a moving coil speaker is reduced in size, the central magnetic pole residing on the shorter radius of the air gap becomes smaller and smaller, and it finally reaches a dimension where it can no longer effectively carry sufficient magnetic flux for an operable speaker. As a practical matter, moving coil speakers are seldom produced having diameters smaller than about 8 mm. On the other hand, the balanced armature technology finds its greatest use in extremely small speakers such as those used for hearing aids within the listener's ear canal. The balanced armature technology has size limitations as it grows larger, because the total excursion of the sound generating surface must be within the limits of the air gap between the static poles. As a practical matter, balanced armature technologies are seldom produced having major dimensions exceeding 10 mm.

A further limitation to the performance of conventional balanced armature electro acoustic devices, (whether used as speakers or microphones) is that their frequency spectra deviate from being perfectly flat, spectral flatness being one representation of a lack of distortion, a very desirable characteristic for acoustic (and most other) transducers. This spectral deviation or "signature" arises from the fundamental structural properties that are characteristic of all conventional balanced armature devices: the mass and springiness of: the armature itself, the sound producing diaphragm and its chamber(s), and, in most conventional speaker of this type, of the connector element and its attachments that link the armature and the diaphragm. Numerous techniques have been developed to minimize the disadvantages of this inherent signature, including, for example, the use of so-called "ferro-fluids" for damping the system and improving the transducer's dynamic performance.

Notwithstanding the substantial enhancements to these general types of transducers, room remains for improving and simplifying the frequency signature, minimizing the frictional and other mechanical losses, and improving the efficiency of this type of speakers. In many applications, it also is desirable to further reduce the size of the transducer. For example, when used in a hearing aid or earphone application, it is desirable to have a transducer that is small enough to comfortably fit within a human auditory canal. Similarly, when used as a component of a device, such as a cell phone, the small size of the transducer allows the size of the device to be minimized.

BRIEF DESCRIPTION OF THE DRAWINGS

The accompanying drawings incorporated in and forming a part of the specification illustrate several aspects of the present invention, and together with the description, they serve to explain the principles of the invention. In the drawings.

BRIEF EXPLANATION OF EXEMPLARY EMBODIMENTS

Figure 1:
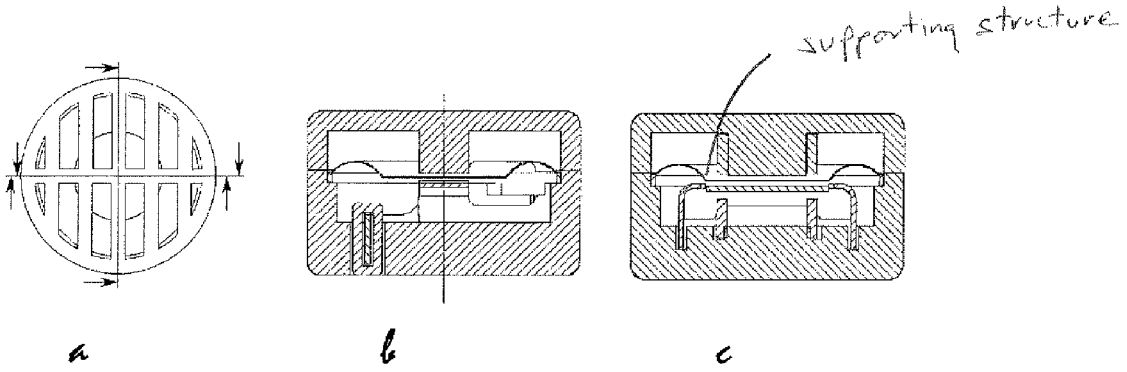
FIG. 1*a* is a plan view of one exemplary embodiment of the invention.
FIG. 1*b* is a cross-sectional view of the exemplary embodiment of FIG. 1*a;*
FIG. 1*c* is another cross-sectional view of the exemplary embodiment of FIG. 1*a;*
Figure 2:
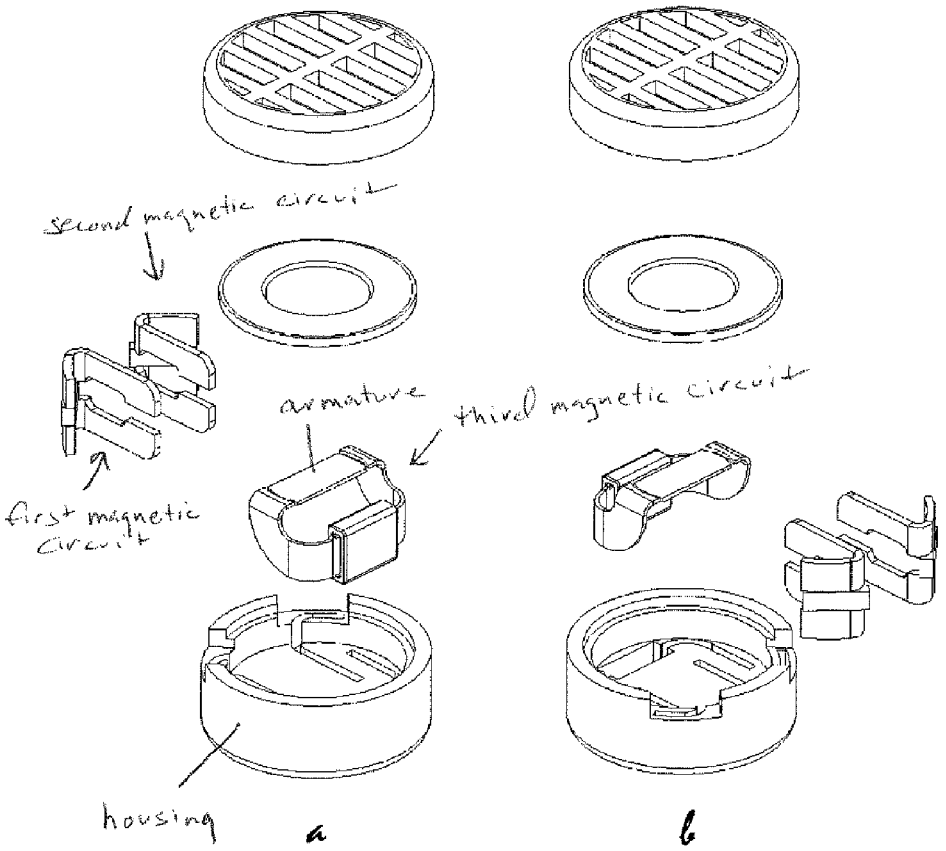
FIG. 2 is an exploded view of the exemplary embodiment of FIG. 1.
Figure 3:
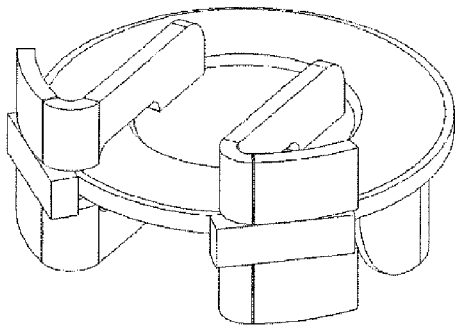
FIG. 3 is a perspective view of an integrated armature with the sound generating surface remaining affixed to the armature, showing the relationships of the sound generating surface in position within the air gaps of the magnetic poles.
Figure 4:
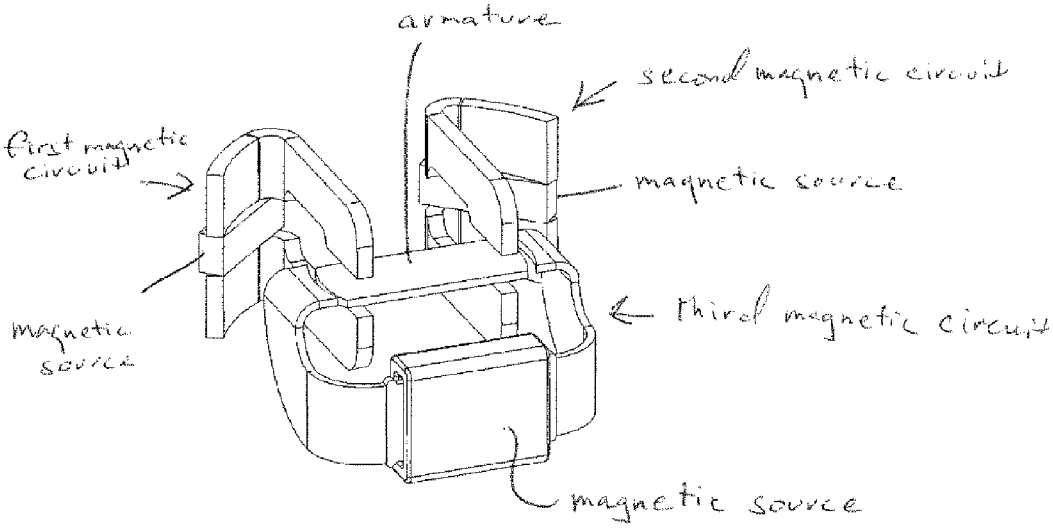
FIG. 4 is a perspective view of the integrated armature with the sound generating surface removed, showing the relationship of the static and movable motor parts of an exemplary embodiment.

In accordance with the principles of the invention, an electromagnetic transducer includes a support structure which, in turn, supports a pair of "first" and "second" magnetic circuit structures each comprising a magnet region, a high permeability material region forming a magnetic path and having an air gap traversing the high permeability material forming therein a of pair of magnetic poles of opposite polarity. The first magnetic circuit is the inverse or mirror of the other, the first having its "north pole" at the topside of the air gap, and the second having its "north" pole at the bottom of the air gap. The magnetic flux lines within the first and second magnetic circuits are generally parallel to one another, but they have opposite senses or directions.

A third magnetic circuit structure, whose magnetic flux lines lie largely perpendicular to the flux lines of the parallel set of first and second magnetic circuits is also is generally supported by the support structure over all but its "armature" portion. This third magnetic circuit structure comprises a coil region, a high permeability material region forming a magnetic path going through as a core to the coil region and emerging from one end of the coil region and progressing in the form of a loop to a position distant from the coil region. At the other end of the coil, a high permeability material region also emerges from the coil and similarly progressing in the form of a loop to a point where its end surface stands across a gap and parallel to its counterpart that emerged earlier from the opposite end of the coil. Between these two surfaces an armature of high permeable material is supported such that at both of its ends there are formed small air gaps between the armature structure and the high permeability portions of the structure running through the coil. The air gaps so formed are at positions such that the magnetic flux lines of the first and second magnetic structures pass through the armature ends respectively. The armature is mechanically supported by a sound generating surface that is itself centrally movable largely perpendicular to the plane of its own extent, and affixed on its periphery to the support structure.

In operation a current is caused to flow through the coil which causes a magnetic field of flux lines to loop through the emergent high permeable material extending on one end of the coil across a first air gap between the stationary high permeable material, progressing through the length of the armature, thence across the second air gap and returning to the coil region via the remaining high permeable material. When the current flows in one direction, the magnetic flux causes a first pair of poles formed at the first air gap, the pole on the armature there being a north pole, and at the other end of the armature there is formed another set of poles, but on this other end, the pole on the armature there is a south pole of equal and opposite magnitude to that on its first end. These opposite poles, so induced in simultaneity by the coil's current, are themselves configured between the first and second magnetic poles of the static magnetic structure, and they are perpendicular to them. Because the first and second air gaps of the static magnetic structures are reversed in polarity with respect to each other, and because the ends of the armature are likewise reversed in polarity with respect to each other, there is a net parallel magnetic force applied to the armature in response to the magnetic flux induced by the current flowing in the coil. As the current in the coil is caused to alternate between plus and minus senses, the resulting force on the armature will also alternate upward and downward with respect to the armature's long axis. As the armature is affixed to the sound generating surface within its movable central region, sound is generated in response to such up and down force moving the sound generating surface in an acoustical vibratory manner.

According to one exemplary embodiment of the invention, an armature of magnetically permeable material is affixed to the vibratable sound-producing member producing thereof an integral element.

According to another exemplary embodiment of the invention, the vibratable sound-producing member is a diaphragm.

In another exemplary embodiment, different radial circumferential portions of the diaphragm have different flexibilities.

In another exemplary embodiment, the diaphragm includes a flexibility enhancing structure disposed circumferentially about the periphery of the diaphragm to enhance the flexibility of the diaphragm and reduce resistance to movement of the diaphragm in a direction substantially perpendicular to the plane of the diaphragm.

In another exemplary embodiment, the flexibility enhancing structure is a surround.

According to another exemplary embodiment, the thickness of the diaphragm in the direction substantially perpendicular to the plane of the diaphragm is variable, with at least one radially outward circumferential portion of the diaphragm having a reduced thickness relative to the thickness of the central portion of the diaphragm.

In another exemplary embodiment, different circumferential portions of the diaphragm are formed of different materials, with the material forming the radially outward circumferential portion of the diaphragm having greater flexibility that is greater than the material in the central portion of the diaphragm.

In another exemplary embodiment, the diaphragm includes a central portion and a radially outward circumferential portion with the radially outward circumferential portion having a magnetic permeability that is substantially less than the magnetic permeability of the central portion.

In another exemplary embodiment, the diaphragm includes a central portion and a radially outward circumferential portion with the radially outward circumferential portion having a lower specific mass than the central portion.

In another exemplary embodiment the armature has two free ends both terminating within the movable portion of the diaphragm.

In another exemplary embodiment two static magnetic circuits form identical but opposites sense air gaps perpendicular to and in relative position to the free ends of an armature.

In another exemplary embodiment the end surfaces of the armature may be shaped to alter the magnetic flux lines across the air gap between said end and the proximal end of the magnetic material extending from the coil region In another exemplary embodiment the proximal end of the magnetic material extending from the coil region to the end surface of the armature may be shaped to alter the magnetic flux lines across the air gap between said end and the armature In another exemplary embodiment there is an upper physical structure to prohibit the armature from ever touching the first or second static magnetic structure In another exemplary embodiment there is an upper physical structure to prohibit the armature from ever touching the first or second static magnetic structure In another exemplary embodiment there is a structure in companion with the upper and/or lower physical structure in the form of a damper In another exemplary embodiment the static magnetic flux in the first and second magnetic structures is produced by a permanent magnet in each of the structures and with opposite polarity.

In another exemplary a permanent magnet in each of the structures and with opposite polarity is a rare earth magnet In another exemplary a permanent magnet in each of the structures and with opposite polarity is an alnico magnet In another exemplary a permanent magnet in each of the structures and with opposite polarity is an iron or soft steel magnet In another exemplary a permanent magnet in each of the structures and with opposite polarity is composite magnet with magnetic particles affixed within plastic or ceramic.

What is claimed is:

1. An electro-magnetic transducer, comprising:

a. a housing for supporting at least a portion of at least three distinct magnetic circuits b. first and second magnetic circuits, the first and second magnetic circuits being structurally configured as mirror images of each other, each of the first and second magnetic circuits including a magnetic source with a pair of magnetically permeable structures extending outwardly from opposite sides of the respective magnetic sources, each pair of magnetically permeable structures forming a gap proximal to their outward end portions, the first and second magnetic circuits being operative to produce magnetic flux densities of equal and opposite polarities in the respective gap of each magnetic circuit;

c. a third magnetic circuit, the third magnetic circuit including a magnetic source and magnetically permeable structure extending outwardly from opposite ends of the magnetic source, the third magnetic circuit being structurally configured so that the structural extensions of the third magnetic circuit terminate with their respective ends facing one another across a predetermined expanse, the third magnetic circuit further including an armature of magnetically permeable material residing in the predetermined expanse with opposite ends of the armature being in spaced relationship to structural extensions of the third magnetic circuit so as to form two gaps, one at each end of the armature, thereby forming a magnetic dipole on the armature, the armature being further positioned so that opposite ends of the armature reside in magnetic flux in the gaps between the respective pairs of magnetically permeable structures of the first and second magnetic circuits; and d. a support member affixed to and supporting the armature, said support member providing selective positional compliance so that its support of the armature is compliant in the direction generally perpendicular to the plane of the support surface and generally non-compliant within such plane, the armature being operative to move under the influence of the interaction of the magnetic fluxes in response to a change in the magnetic flux created by at least on of the magnetic circuits.

* * * * *